US005269702A

United States Patent [19]

Bacher et al.

[11] Patent Number: 5,269,702

[45] Date of Patent: Dec. 14, 1993

[54] COAXIAL SUPPORT STRUCTURE

[75] Inventors: Helmut Bacher, 6488 Normandy Dr., Newark, Calif. 94560; Daniel H. Bacher, 712 Carlisle Way, Sunnyvale, Calif. 94087

[73] Assignee: Helmut Bacher, Newark, Calif.

[21] Appl. No.: 968,034

[22] Filed: Oct. 23, 1992

[51] Int. Cl.[5] ..... H01R 13/00

[52] U.S. Cl. ..... 439/578

[58] Field of Search ..... 439/578-585

[56] References Cited

U.S. PATENT DOCUMENTS

| | | | |
|---|---|---|---|
| 2,439,841 | 4/1948 | Carsten et al. | 439/578 |
| 2,449,073 | 9/1948 | Johannesen | 439/578 |
| 2,719,279 | 9/1955 | Muckler | 439/578 |
| 2,966,645 | 12/1960 | Bird et al. | 439/578 |
| 4,360,245 | 11/1982 | Nikitas | 439/578 |
| 4,981,445 | 1/1991 | Bacher et al. | 439/578 |
| 5,133,680 | 7/1992 | Watson et al. | 439/824 |

*Primary Examiner*—Joseph H. McGlynn

*Attorney, Agent, or Firm*—Michael J. Hughes

[57] ABSTRACT

A coaxial support structure (10) is provided to providing an interface and support for microwave transmission components. The preferred coaxial support structure (10) includes a hollow cylindrical outer conductor (12), a hollow cylindrical inner conductor (14) disposed coaxially therewithin, and a dielectric spacer (16) providing separation and mutual captivation. The dielectric spacer (16) has odd symmetry, preferably trilateral, and has an end gap (70) separating the spacer end surface (68) from the end planes (38) in which the respective end surfaces (36,50) of the conductors (12,14) are disposed. The inner conductor (14) is provided with spiral grooving (52) on its peripheral surface (46) to provide excellent captivation by the central tube portion (64) of the dielectric spacer (16) with minimal effect on the transmission. Optional features include threading (58) on the interior surface (48)of the inner conductor (14) and a dust washer (72) for disposal within the end gap (70).

17 Claims, 4 Drawing Sheets

COAXIAL SUPPORT STRUCTURE

TECHNICAL FIELD

The present invention relates generally to electromagnetic wave structures and connectors and more specifically to coaxial structures adapted for use in supporting or connecting conductive coaxial transmission lines for TEM mode propagations. The preferred embodiment is a double female connector component adapted for use in microwave and related applications.

BACKGROUND ART

The demand for improvements in devices to support and connect coaxial transmission lines has risen greatly in recent years with improved communications and electromagnetic wave transfer techniques. Higher frequency usages have greatly expanded the demand placed upon these sorts of structures. Different configurations, dimensions and materials have been utilized to improve performance under ever more critical conditions.

One area in which a number of substantial modifications and improvements have occurred over the years is that of microwave connecting devices particularly coaxial devices. These coaxial structures provide an effectively transparent interface between two conductive coaxial lines which carry the microwave energy, and, therefore, messages or the like. These have been adapted for a variety of purposes and have included improvements intended to solve specific problems. One such improved connector is described in U.S. Pat. No. 4,981,445, issued to one of the present co-inventors, Helmut Bacher and to Egon Seiter. This '445 patent, which is incorporated herein by reference, includes a substantial discussion of the purposes of the microwave connector and the nature of components which have been utilized in the prior art.

Various other improvements, such as those referred to and cited in the Bacher/Seiter '445 patent have also been made with the intent of improving performance. However, none have been entirely successful in keeping up with the increasing demands for higher frequency and optimized microwave performance factors.

One of the most significant factors, besides negative aspects, such as moding at frequencies other than desired TEM modes, fringing capacitance and others, is the mechanical fit between the support element itself and the external plug element with which it is adapted to mate. Achieving precise dimension and uniformity in the mechanical fit is highly important and is critical to performance, particularly in microwave applications. Accordingly, improvements in uniformity of the structure of the support structures and connectors, as well as optimizing the configuration structure to optimally handle the particular type of electromagnetic energy being transferred therethrough, are very important characteristics. The improvements in this area are the primary goals of the present invention, which have not been properly addressed in an economical manner in the prior art.

DISCLOSURE OF THE INVENTION

Accordingly, it is an object of the present invention to provide an improved coaxial support structure which is light weight, uniform, lends itself to standardization, and inexpensive to manufacture.

It is another object of the present invention to provide a coaxial support structure which has both improved outer conductor captivation and improved inner conductor captivation.

It is a further object of the present invention to optimize the compensation for the transition from dielectric to air in the appropriate frequency range.

It is still another object of the present invention to provide improved mechanical support.

It is yet another object of the present invention to provide extremely flat end surfaces for uniform interfaces, particularly in those portions of the device through which the prime microwave energies pass.

It is still a further object of the present invention to provide an optional dust wall.

Briefly, a first preferred embodiment of the present invention is a coaxial support structure including a cylindrical outer conductor and a cylindrical inner conductor which are separated by a dielectric spacer. The specific preferred embodiment is a double female coaxial microwave support structure (connector) which is essentially trilateraly symmetrical about a central longitudinally axis and is also symmetrical about a longitudinal bisecting plane which is perpendicular to the axis. The support structure includes three primary structural components, these being a cylindrical outer conductor, a cylindrical inner conductor and a dielectric spacer separating the two conductors. The support structure is adapted to mate with two male connecting plugs threaded or unthreaded from whatever line source or equipment is designed to be connected utilizing the structure. Although the preferred embodiment shown is a double female support structure, and this is the best known present embodiment of the inventive structure, male structures, male-female structures and other interior coaxial support structures are also compatible with the teachings of the invention and may be derived therefrom. However, since some of the primary advantages are best shown in respect to the female connector, this is what will be described.

An advantage of the present invention is that the dielectric spacer design avoids problems associated with the dielectric spacer shrinking with respect to the outer conductor element, and therefore causing a non rigid outer assembly and unstable mechanical captivation.

Another advantage of the present invention is that it provides excellent mechanical captivation of the center pin conductor of an associated plug. The captivation is axial, radial and rotational in the preferred embodiment.

It is a further advantage of the present invention that it provides extremely flat end surfaces particularly in critical areas, thus providing minimum mismatch and maximum repeatability in assemblies.

It is yet another advantage of the present invention that the dielectric spacer is extremely firmly seated with respect to both the outer conductor and inner conductor such that no wiggling or pivoting is allowed, thus improving transmission and environmental characteristics.

It is still another advantage of the present invention that the dielectric spacer does not directly touch the external connecting transmission lines and provides a specified air gap therebetween, thus minimizing the creation of fringing fields providing compensating series inductance for the residual capacitance.

It is a still further advantage of the present invention that the overall length of the structure may be modified or selected for the particular frequency involved such that the length and the gap inductance may optimally cancel reflection interferences at the specified frequency.

It is still another advantage of the present invention that the improved trilateral symmetry makes the support structure readily adaptable to a variety of coaxial transmission conditions, e.g. digital signal transmissions, such that the usage of the invention is not limited to microwave signal usages only.

It is still another advantage of the present invention that it provides for an optional thin dust cover wall, in those situations where it is desirable, without degrading the quality of the contact between the conductive elements.

It is yet another advantage of the present invention that the outer conductor, the inner conductor and the dielectric spacer may all be machined, subsequent to molding, to have extremely uniform and flat parallel end surfaces, in order to provide maximum transmission and adaptability for precision microwave connections, in accordance with standards in the field.

It is a still further advantage of the present invention that the formation of the dielectric spacer may be performed in situ utilizing a single injection port.

These and other objects and advantages of the present invention will become clear to those skilled in the art in view of the description of the best presently known mode of carrying out the invention, and the industrial applicability of the preferred embodiment and the other contemplated embodiments, as described herein and as illustrated in the several figures of the drawings.

BEST MODE FOR CARRYING OUT THE INVENTION

Figure 1:
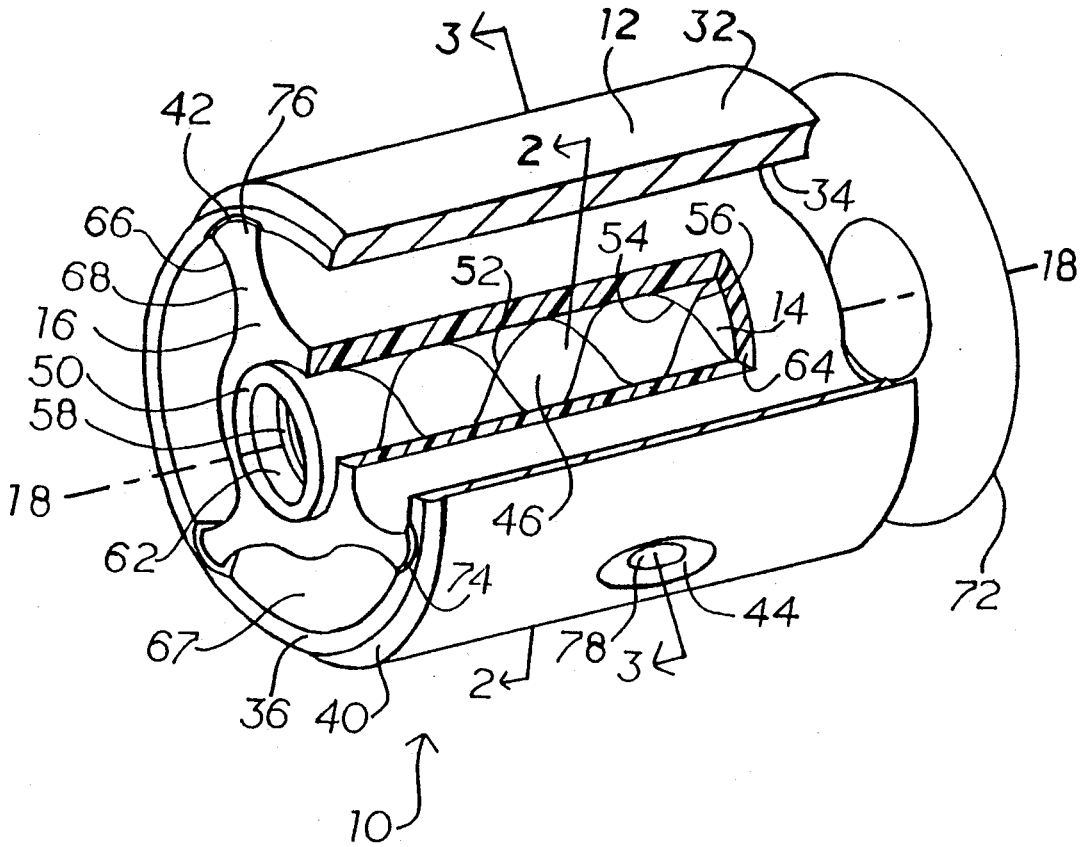
FIG. 1 is a partially cutaway perspective view of a coaxial support structure according to the preferred embodiment of the present invention, in the form of a double female threaded structure.

The best presently known and described mode for carrying out the invention is a coaxial support structure in the particular form of a double female structure adapted for use in applications analogous to microwave connection uses. The preferred embodiment coaxial support structure is illustrated in all four figures of the drawings and is designated therein by the general reference character 10. The coaxial support structure 10 is illustrated standing alone in FIGS. 1, 3 and 4 (slightly modified) and is shown in connection with associated threaded external plug connectors in FIG. 2.

Referring now to the drawings, the coaxial support structure 10 may be seen to include three distinct structured elements, these being an outer connector 12, an inner conductor 14 and a dielectric spacer 16 formed intermediate the conductors 12 and 14. The support structure 10 is generally trilateraly symmetrical about a longitudinal central axis 18 and is bilaterally symmetrical about a pair of mutually perpendicular bisecting planes **19*a* and 19*b*, bisecting plane 19*a* being perpendicular to the central axis 18, and bisecting plane 19*b* including the central axis 18, both including input port through which the dielectric spacer 16 is injection molded into place, the only irregularity in the structure 10**.

Figure 2:
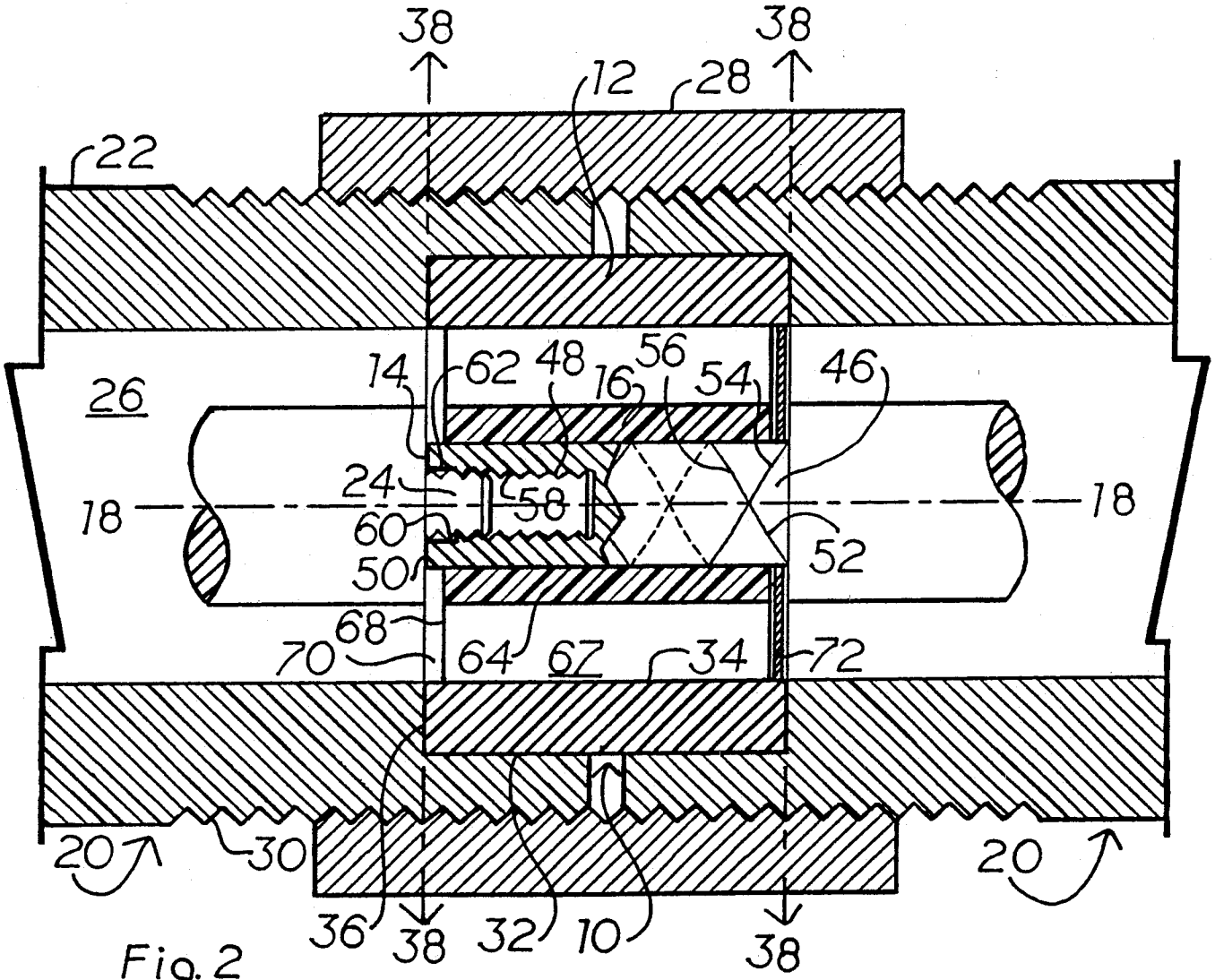
FIG. 2 is a cross-sectional view taken along the line 2—2 of FIGS. 1 and 4 of the preferred embodiment, and also showing the components of associated external connection elements.

The particular preferred embodiment of the support structure 10 is a form of a double female connecting element which is adapted to mate with a pair of external male plug elements 20, such as are illustrated in cross-section view in FIG. 2. The external plug elements 20, which are conventional in nature, include an outer rim conductor 22, a center pin conductor 24 and an intermediate insulator 26 which is ordinarily in the form of a dielectric (frequently, primarily air space). A securing nut 28 is adapted to mate with securing threads 30 formed on the external surface of the outer rim conductors 22 of the associated plug elements 20. The securing nut 28 is tightened about the associated securing threads 30 in order to force the external plug 20 about the coaxial structure 10 and to provide a tight mechanical fit and good microwave contact. When it is desired to disconnect the plugs 20 from the coaxial structure 10, the securing nut 28 is disengaged by rotating the plugs 20 with respect to one another so that the plugs may be axially removed. As will be discussed hereinafter with respect to the inner conductor 14, the interface between the external plugs 20 and the coaxial structure 10 may be optionally further enhanced by a threaded attachment between the center pin conductor 24 and the inner conductor 14.

The outer conductor 12 is illustrated in each of the figures. The outer conductor 12 is a generally hollow cylindrical element having a peripheral surface 32, a interior surface 34 and a pair of opposing end surfaces 36. Like the remainder of the coaxial support structure 10, the outer conductor 12 is symmetrical about the bisecting planes **19*a* and 19*b*. Consequently, the end surfaces 36 on each end of the outer conductor 12** is substantially identical.

The end surfaces 36 of the outer conductor are lapped or ground after molding to be extremely flat and to lie entirely within an end plane 36 which is parallel to the bisecting plane 19. Since, as is shown in FIG. 2, the end surface 38 is adapted to mate with the outer rim conductor 22 of the external plug 20, it is important that a uniform flat surface at the end plane 38 be provided in order to define the microwave contact between the outer rim conductor 22 and the outer conductor 12 and to further establish two reference surfaces. The flatness assures that minimal end surface irregularity contribution is made to the tolerance accumulation of the total assembly. Since the nature of microwave transmission in coaxial elements results in the interior surface 34 being the locus of the transmission through the outer conductor 2, uniformity at this interior surface 34 is the most significant for performance characteristics.

Although the primary component of the end surface 36 is flat, a chamfer 40 is optically circumferentially provided about the interface between the end surface 36 and the peripheral surface 32. Although it would be desirable to have a sharp interface between the peripheral surface 32 and the end surface 36, due to the surface transmission characteristics, the chamfer 40 has a minimal negative effect on the transmission characteristics. The chamfer 40 is desirable in order to properly hold the outer conductor 12 in position for machining and molding processes. The chamfer 40 is an optional characteristic which provides excellent microwave contact definition and in order to facilitate other manufacturing steps.

Slightly inset from each of the end surfaces 36 and separated radially by 120°, are three equally spaced tapered depressions 42. The tapered depressions 42 which will be discussed further, provide the means for securing the dielectric spacer 16 in position with respect to the outer conductor 12.

A single injection port 44 is situated extending from the peripheral surface 32 through the interior surface 34. Only a single injection port 44 is required with the present invention. No material output ports are necessary for the preferred configuration. The location of the injection port 44 is aligned with one pair of opposing tapered depressions 42 and centered on both of the bisecting planes 19*a* and 19*b*.

The inner conductor 14 is also illustrated in all of the figures. In the preferred embodiment the inner conductor 14 include a peripheral surface 46, the majority which is enclosed within the dielectric spacer 16, an interior surface 48 and a pair of opposing end surfaces 50. The end surfaces 50 of the inner conductor 14 are also lapped or ground after molding (ordinarily in a common operation with the end surfaces 36 of the outer conductor 12) to be exceedingly uniform and flat and to lie coincidentally within the end plane 38. The flatness and the coplanar alignment of the end surfaces 50 of the inner conductor 14 with the end surfaces 36 of the outer conductor 12 provides for extreme predictability and uniformity of the microwave contact and minimum overall tolerance accumulation. This is extremely valuable for microwave connector applications. Due to coaxial surface transmission effects, the peripheral surface 46 is the most critical for transmission characteristics.

As is especially shown in the cutaway portion of FIG. 1, the peripheral surface 46 of the inner conductor 14 is provided with spiral grooving 52 to facilitate mechanical captivation of the inner conductor 14 by the dielectric spacer 16. The spiral grooving 52 extends the entire length of the peripheral surface 46 and includes a clockwise groove 54 and a counterclockwise groove 56. The spiral grooving 52 is provided to be deep enough to provide complete mechanical captivation of the inner conductor 14 with respect to the outer conductor 12 while causing minimal discretion of the surface characteristics of the peripheral surface 46. The mechanical captivation is highly desirable and insures that the inner conductor cannot move axially (axis 18) or twist rotationally with respect to the outer conductor 12 and that the spacing between the interior surface 34 of the outer conductor 12 and the peripheral surface 46 of the inner conductor 14 is uniform along the entire length of the structure.

Since the peripheral surface 46 is the primary locus of microwave locus of microwave transmission through the inner conductor 14, any modification thereof must be compensated for in order to maintain uniform and predictable transmission. In the present invention 10, The outside diameter of the inner conductor 14 (the average diameter at the peripheral surface 46) is slightly enlarged to compensate for the characteristic impedance change induced by the presence of the spiral grooves 52. In the preferred embodiment 10, the spiral grooving 5 is turned into the peripheral surface 46 and may be square, v-shaped or parabolic in cross-section, as it has been found that the particular cross sectional shape is not critical to captivation, since the nature of the opposed clockwise groove 54 and counterclockwise groove 56 provides for excellent mechanical captivation. It is desirable that the cross sectional shape of the grooves 52 be reasonably uniform, however, in order to simply the calculation (and/or empirical determination) of diameter modification required to obtain the best results.

The interior surface 48 of the inner conductor 14 is optionally provided with female threading 58, which is particularly adapted to mate with corresponding male threading 60 on the center pin conductor 24 of the conventional external male plug 20 as is shown in FIG. 2. Due to the surface transmission effect discussed above, the female threading 58 does not significantly interfere with the transmissive capability of the inner conductor 14 or the surface current. In the threaded version of the inner conductor 14, the female threading 58 is inset somewhat from the end surfaces 50 in order to provide for a pair of opposing end guide sections 62 which allow for smooth insertion of the center pin conductor 24 into the coaxial structure 10 prior to the necessity of beginning the threaded interface. The threaded interface between the external plug 20 and coaxial structure 10 provides for a good packaging solution which combines excellent mechanical captivation and transmission characteristics. This threading can also assure that the end plugs are captivated axially, radially and rotationally.

Figure 4:
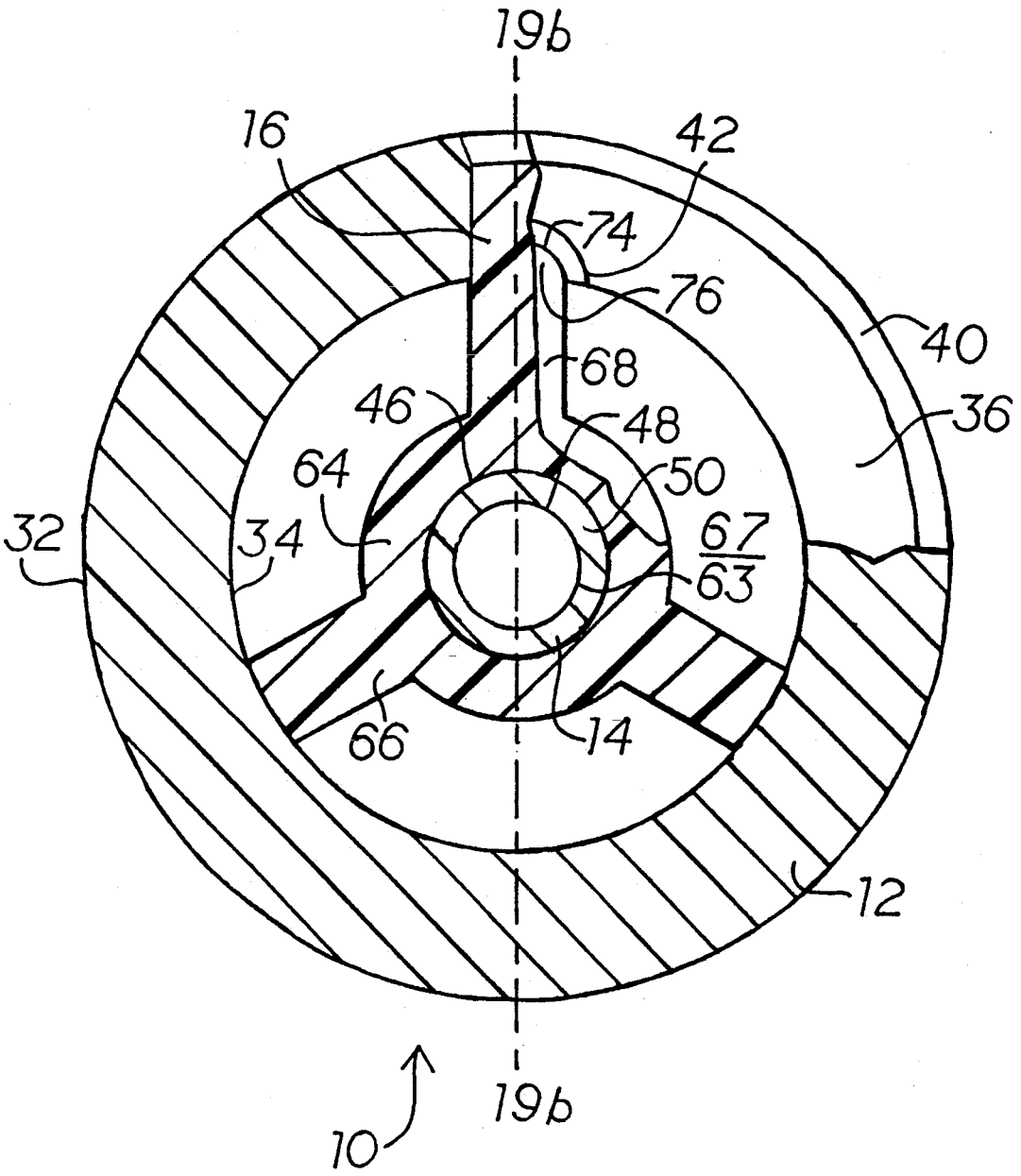
FIG. 4 is a partially cutaway end view of the preferred embodiment.

An alternative unthreaded version of the inner conductor 14 is also envisioned. This structure, as is illustrated in FIG. 4, does not include interior threading 58 on the interior surface 48, but rather provides a smooth bore 63. The alternative inner conductor 14 with the smooth bore 63 is particularly adapted with types of exterior structures having tightening mechanisms which are adapted to secure directly to one another at the center pin as well as along the outer rim. In this case one exterior conductor will typically include a center pin which extends completely through the smooth bore 63 to mate with a complementary receptacle on the opposing external conductor. For this usage, the coaxial support structure 10 serves a mechanical function akin to that of a washer or spacer, wherein it provides spatial support and integrity in axial and radial dimensions, but does not directly provided rotational support, since that is a function of the external elements.

The third structural member of the coaxial support structure 10 is the dielectric spacer 16. The dielectric spacer 16 provides physical separation and relative position captivation of the outer and inner conductors 12 and 14 in axial, radial and rotational aspects. The dielectric spacer 16 also provides uniform spacing and prevents conductance between the outer conductor 12 and the inner conductor 14, thus maintaining the coaxial nature and constant characteristic impedanece of the support structure 10.

The reason for this is to provide uniform cross sectional geometry throughout the axial extent of the coaxial structure 0. While the outer conductor 12 and the inner conductor 14 are typically structures of highly electrically conductive materials, such as copper, silver, aluminum or alloys thereof, the dielectric spacer 16 is selected to be an electromagnetic insulator, a non-conductor for microwave frequencies with minimum losses. For the preferred embodiment, and for ease and economy of manufacture and high temperature performance, the preferred material for the dielectric spacer 16 is a plastic known by the tradename of "Ultem", obtained from General Electric. This material has been found to be excellent for high temperature uses and for facility in molding the products. In the event that precision connectors having the highest mechanical stability are required, fused quartz may be the desired material. On the other hand, if one of the primary characteristics is heat conduction, then boron nitride and beryllium oxide are acceptable material selections. Given the geometry of the coaxial support structure 10, however, it is desirable to select materials having relative dielectric constants in the vicinity of two to seven.

The dielectric spacer 16 includes a central tube section 64 which envelops all but the end of the center conductor 14. In the preferred embodiment the central tube section 64 provides an enveloping cylinder about the peripheral surface 46 of the inner conductor 14 and will have an approximate wall thickness of 0.045 cm (0.018 in), such that, in the interior of the coaxial support structure 10 (as opposed to the ends, as discussed hereinafter), none of the peripheral surface 46 is exposed. Integrally formed with and extended radially outward, at 120° mutual separational spacing, from the central tube 64 are three substantially identical trilateral vane members 66. The trilateral vane members 66, which are radially separated by interstices 67 (air spaces), provide the structural separation and positioning for the coaxial support structure 10. The interstices 67 provide further low loss structures and also form a part of the characteristic impedance determination. As is discussed in greater detail in Inventor Helmut Bacher's prior patent, U.S. Pat. No. 4,981,445, the trilateral symmetry of the vanes 66 with the intermediate interstices 67 is particularly valuable in optimizing microwave transmission characteristics.

The dielectric spacer 16 is integrally molded whole having a contiguous end surface 68 on each end thereof. The spacer end surface 68 is partially on the central tube section 64 and partially on the trilateral vanes 66 which are formed therewith. The spacer end surface 68 is molded to be as uniformly flat as possible and to lie entirely within a plane parallel to the bisecting plane 19*a*, but it is specifically displaced from the end plane 38. Uniformity is further provided by machining after molding, if necessary. This inward displacement of the spacer end surface 68 creates an end gap 70. The end gap 70 is provided such that the conductive contact between the conductors of the coaxial support structure 10 and the external plug 20 may be achieved without any physical contact whatsoever between the dielectric spacer 16 and the insulator 26 of the external plug 20, or any other portion of the external plug 20. The end gap 70 elegantly compensates for parallel fringing capacitance created by any dielectric to air transitions. The specific width of the end gap 70 is selected dependent on the expected usage frequency range of the coaxial structure 10, with the parameters being selected as discussed hereinafter with regard to the industrial applicability of the structure.

A further purpose of the end gap 70 is to provide a location for an optional dust washer 72. Some users prefer and certain applications make it desirable to have a dust washer 72, such as is illustrated in FIGS. 1 and 2, inserted intermediate the non-conducting portion of the coaxial structure 10 and the external plug 20. In the present invention the dust washer 72 fits circumferentially around the inner conductor 14, inside the outer conductor 12, and within the end gap 70. One significant purpose of the dust washer 72 is to prevent contaminants from getting into the interstices 67 and having a detrimental affect on the transmission characteristics. A preferred variety of dust washer 72 can be constructed from Teflon TM tape having an adhesive surface on one side for securing to the spacer end surface 68. The dust washer 72 is sufficiently thin [approximately 0.0025 cm (0.001 inch thick)] that no significant imbalance occurs which affects the characteristic impedance calculation. If necessary, compensation for specific selections of dust washers 72 may be accomplished by altering the depth of the end gap 70.

Each of the trilateral vanes 66 extends from the central tube 64 to the interior surface 34 of the outer conductor 12. As is especially shown in FIG. 4, the trilateral vanes 66 have relatively uniform thickness throughout their radial length and do not spread to encompass a substantial portion of the inner surface 34 of the outer conductor 12. The vane thickness and spacing represents an optimization of various factors including mechanical stability and strength, minimized microwave losses (the higher the volume ratio of interstices 67, or air space, the vanes 66, or solid, the lower the microwave losses), and susceptibility of occurrences of high order modes (minimum vane volume and vanes arranged to avoid 180° physical orientation). The preferred structure 10 is formed with all of these factors being considered. It has been found that substantial spreading is not necessary in order to maintain sufficient positioning, as will be described hereinafter, and further that such is not desirable from the standpoint of optimal manufacturing tooling considerations, transmission characteristics, and minimization of material cost.

The radial vane ends 74 terminate against the interior surface 34 and are substantially uniform along their length, except at the locations where the radial vane ends 74 interface with the tapered depressions 42. At these locations, the material utilized to form the dielectric spacer 16, during the molding process, forms positioning beads 76 which extend radially outward into the tapered depressions 42 formed in the outer conductor 12. It is noted that the positioning of the tapered depressions 42 is such that the interior extents are nearer to bisecting plane 19*a* (the center) than is the spacer end surface 68. The tapered depressions 42 are deep enough to assure that a relatively substantial positioning bead 76 will be formed within each of the six tapered depressions 42. The positioning beads 76 are formed during molding and, because of the shape of the tapered depressions, 42 will provide tight mechanical captivation and secure positional integrity to the dielectric spacer 16 with respect to the outer conductor 12. The contraction of the spacer material upon cooling at the latter stages of the molding process, tightens the fit. The tapering of the tapered depression 42 and the fact that the positioning beads 76 are molded in such a manner that they fill the available space within the tapered depression 42 means that the positioning beads 76 abut firmly against the surface of the tapered depressions 42. This abutment, from the combined six tapered depressions 42, assures that there is no slippage or shifting in the positioning of the dielectric spacer (and consequently the inner conductor 14) in any dimension. Further, the tapered depressions 42 are tapered in such a manner that any shrinkage of the material of the dielectric spacer 16 (such as during cooling ) will actually tighten the fit between the positioning beads 76 and the associated tapered depression 42. This will occur because the materials of the dielectric spacer 16 will shrink uniformly toward a center position and will actually create a more secure fit in such an event. The six point securing provided by the interface between the position beads 76 and the tapered depression 42 also prevents any pivoting or other shifting in the dielectric spacer 16 during usage, a problem which occasionally occurred with prior art structures.

Figure 3:
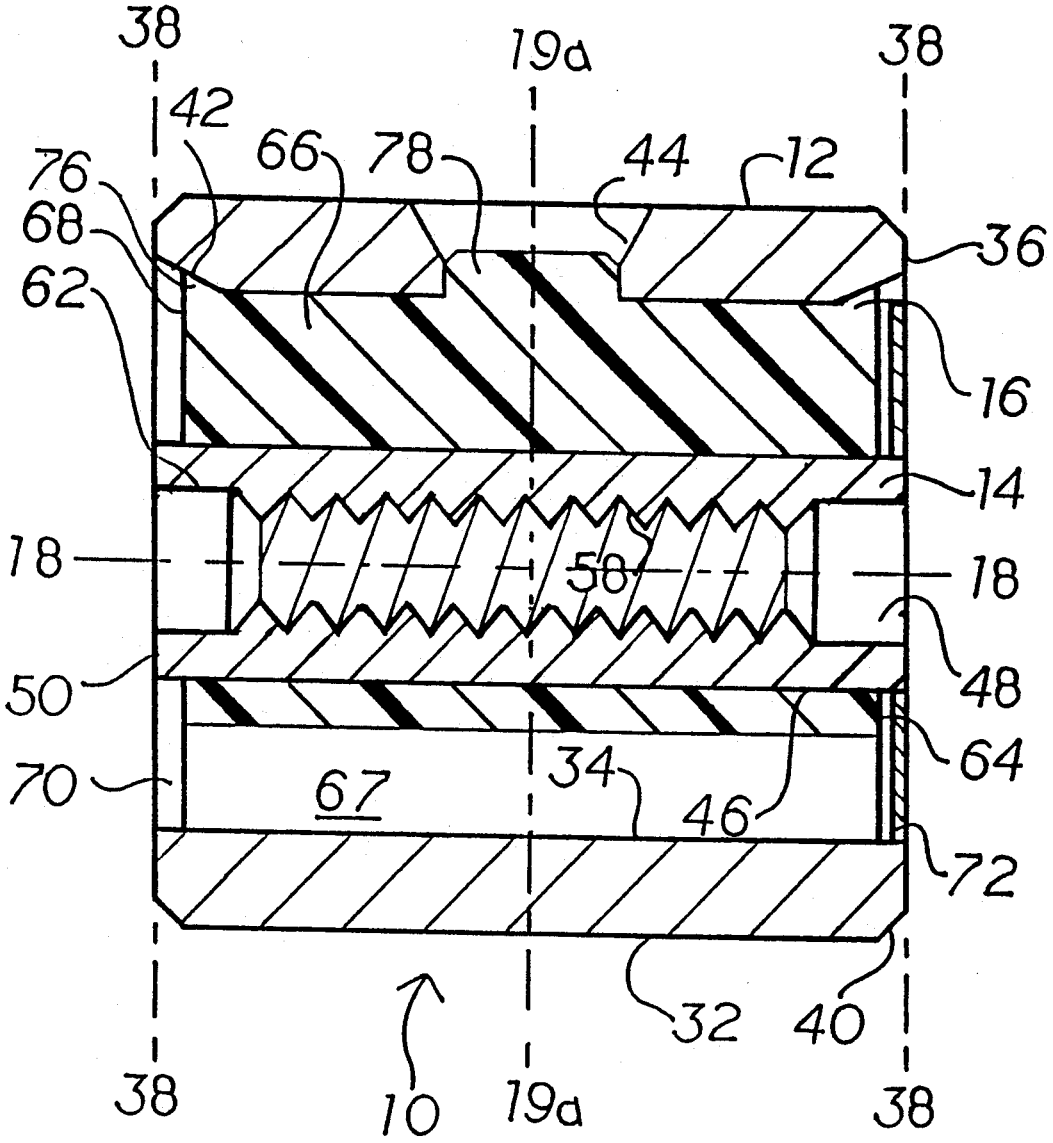
FIG. 3 is a cross-sectional view taken along line 3—3 of FIGS. 1 and 4, showing the preferred embodiment of a dual female structure.

An injection plug 78 is particularly shown in FIGS. 1,3 and 4, also provides some mechanical interface between the dielectric spacer 16 and the outer conductor 12. However, unlike in co-inventor's prior design (the '445 patent) only a single injection plug 78 remains in interface with the injection port 44, resulting in reduced clean-up efforts. Because of the other methods of securing the dielectric spacer 16, the interface between the injection plug 78 and the injection port 44 does not become a pivot or degrade the mechanical fit even if the materials of the injection plug 78 shrinks away from the interior surface 34 of the injection port 44.

The preferred embodiment of the coaxial support structure 10, in the form of a dual female connecting component, is manufactured by forming the tubular outer conductor 12 and the tubular inner conductor 14 of an appropriately selected conductive material. The outer conductor 12 is then mechanically turned of formed to include the chamfer 40 and is drilled to provide an injection port 44. Similarly, the preferred inner conductor 14 is mechanically turned to include the interior female threading 58 and the exterior spiral grooving 52. The alternative inner conductor 14 includes the smooth bore 63. The outer conductor 12 and inner conductor 14 are then placed in securing devices within a molding tool element so as to be properly positioned with respect to each other, The dielectric spacer 16 is provided by injection molding techniques. The molten or flowable material of the dielectric spacer 16 is injected through the injection port 44 and, using known molding techniques, is caused to encompass the inner conductor 14 within the central tube portion 64, with the material of the dielectric spacer 16 mechanically entering the spiral groves 52 under pressure in such a manner that, once solidified, no twisting or turning or shifting of the inner conductor 14 can occur with respect to the central tube 64. Further, the dielectric plastic material will expand to form the trilateral vanes 66 and extend into the tapered depressions 42 to form the associated positioning beads 76. When the material solidifies it will then secure, by contraction, the dielectric spacer 16 (and the associated inner conductor 14) with respect to the outer conductor 12 as described above. After molding, all of the end surfaces, 36, 50 and 68 will be machined to insure flatness, with the conductor end surfaces 38 and 50 being lapped to uniformity coincide with the end planes 38.

Once the coaxial support structure 10 has been constructed in the desired configuration for the expected usage, the user will then determine whether or not it is desirable to incorporate a dust washer 72. If so, a dust washer 72 will be placed against the spacer end surface 68, within the end gap 70, on one or both ends of the coaxial structure 10.

External plug elements 20 of the type illustrated in FIG. 2 may then be connected to the coaxial support structure 10 by screwing the external plugs 20 counter to one another, with the coaxial support structure 10 therebetween, such that a tight engagement is provided by the interaction of the male threading 60 and the female threading 58 and the end surfaces 36 and 50 are in uniform planar abutment with the corresponding surfaces on the rim conductors 22 and 24. In most cases, and as is shown in FIG. 2, a securing nut 28 may be engaged to tighten the fit, to supply contact pressure on the conductive surfaces and to prevent any dislodgement. With the alternative inner conductor 14, a similar process is utilized which conforms to The nature of external elements utilized.

For one specific application known to the inventors, that is for use as sexed or sexless microwave connectors adapted to optimally transmit microwave signals at a frequency of up to 50 GHz, the dimensions and materials are as set forth below. The outer conductor 12 will have a length of 0.316 cm (0.126 in), an outside radius of 0.20 cm (0.080 in) and an inside radius of 0.146 cm (0.058 in). The tapered depressions 42, six in number with three at each end, as shown in the drawings, and being separated by 120° (center to center) are accomplished by drilling or forming inward from the end surfaces 36 at an angle of 33° from a location displaced 0.024 cm (0.010 in) from the peripheral surface 32. This results in a effective longitudinal depth of the tapered depression 42 of 0.048 cm (0.019 in). The preferred outer conductor 12 is formed of gold plated hard brass.

Similarly, for this application, the inner conductor 14 has the same length as the outer conductor 12. The inner conductor 14 has an outside radius of 0.045 cm (0.018 in) and an inside 0.6 mm metric thread. The guide sections 62 are selected to have a length of 0.076 cm (0.030 in) and the female threading 58 has a effective length of (0.060 in). The spiral grooving 52 is adapted to have a depth of approximately 0.005 cm (0.002 in) and a similar width and the clockwise grove 54 and the counterclockwise grove 56 are each adapted to spiral three and one half times over the length of the peripheral surface 46 and therefore to cross each other at about six points. The material of the inner conductor 14 is also selected to be gold plated hard brass.

The preferred dielectric spacer 16 will be formed of molded "Ultem" from General Electric as described above. The approximate thickness of the central tube section 64 is selected to be 0.038 cm (0.015 in), and the radial thickness of each trilateral vane member 66 is similarly selected to be 0.035 cm (0.014 in). The preferred thickness of the end gap 70 is 0.018 cm (0.007 in), such that the positioning beads 76 overlap with the tapered depressions 42 for approximately 0.030 cm (0.012 in) of length.

After injection molding of the dielectric spacer 16, the end surfaces 36, 50, 68 are mechanically lapped or ground to uniform flatness and alignment. Deburring may also be used to eliminate any residual protrusions or material flaws.

If the coaxial support structure 10 is intended for use at higher (or lower) maximum frequencies, the structural geometry may be scaled accordingly to obtain equivalent results.

As discussed previously, various alterations of the described embodiment are feasible. The support structure 10 described, although illustrated in a dual female support structure, is adaptable for use in variety of connectors and support components in transmission structures. Differing materials may also be substituted, providing the conductive, dielectric and thermal expansion properties are carefully monitored. Another modification which is contemplated is the substitution of the trilateral symmetry of the preferred embodiment 10 with an alternate variety of odd symmetry, as discussed in the '445 patent.

Those skilled in the art will readily observe that numerous other modifications and alterations of the apparatus and structure of the present invention may be made while retaining the teachings of the invention. Accordingly, the above disclosure is not intended as limiting. The appended claims are therefore to be interpreted as encompassing the entire spirit and scope of the invention.

INDUSTRIAL APPLICABILITY

The coaxial support structure 10 of the present invention is adapted to provide excellent microwave transmission characteristics, particularly low loss, good match, TEM mode coaxial usage. The primary presently contemplated usage of the invention is as a microwave connector for the purpose of providing an interface between transmission units. The symmetry and the extremely flat end surfaces provide for minimum mismatching and optimal compensation in desired frequency ranges. In addition, the length of the coaxial structure 10 may be selected, depending on the frequency desired, to optimally compensate for end transition parameters while maintaining excellent mechanical support.

The coaxial support structure 10 of the present invention provides excellent mechanical and transmission characteristics and avoids problems which have been encountered in the prior art with respect to material shrinkage, fringing capacity compensation, incomplete longitudinal symmetry, non-uniform end surfaces and the non-optional nature of the prior dust covers. Substantially improved mechanical captivation of the components prevents any shifting, wobbling or pivoting of the inner conductor 14 with respect to the outer conductor 12 during usage. This avoids erratic behavior in the transmission of the microwave signals. The adaptability of modifying the length of the overall unit and the width of the end gaps 70 in order to compensate for specific circumstances occurring at selected frequencies also increases the adaptability of the structure 10.

For all of the above reasons, and for additional reasons which will become apparent to those skilled in the art, in light of the objects and advantages set forth above, it is expected that the coaxial support structure of the present invention will have commercial utility and industrial applicability which are both widespread in nature and long lasting in duration.

We claim:

1. A coaxial support structure, comprising:

an outer conductor having two opposing ends, said outer conductor including tapered depressions formed on the interior surface thereof, the tapered depressions tapering from the ends toward the interior of the interior surface;

an inner conductor disposed coaxially within said outer conductor such that the corresponding ends of said outer conductor and said inner conductor are coplanar, said inner conductor including scrolling on the outer surface thereof;

a dielectric spacer disposed intermediate said outer conductor and said inner conductor, said dielectric spacer mechanically interfacing with said inner conductor about the scrolling and being secured to the outer conductor such that said dielectric spacer and said inner conductor are captivated so as to be stationary with respect to said outer conductor, with relative motion being precluded in axial, radial and rotational dimensions, said dielectric spacer interfacing with the tapered depressions on each end of said outer conductor to provide the mechanical captivation.

2. The coaxial support structure of claim 1 wherein said dielectric spacer includes a central tube portion surrounding and capturing said inner divider; and an odd plurality of equally spaced radial vane members extending radially from the central tube section to said outer conductor.

3. The coaxial support structure of claim 1 wherein said dielectric material is subject to cooling shrinkage subsequent to placement within said outer conductor, the cooling shrinkage leading to increased mechanical captivation of said dielectric spacer by the tapered depressions of said outer conductor.

4. The coaxial support structure of claim 1 wherein said dielectric spacer is insertion molded in position within said outer conductor.

5. The coaxial support structure of claim 1 wherein the scrolling is in the form of a pair of opposing spiral grooves.

6. The coaxial support structure of claim 1 wherein said dielectric spacer is axially shorter than said outer and inner conductors, such that an end gap is formed on each end thereof between the end of said dielectric spacer and the plane including the corresponding end surfaces of said outer conductor and said inner conductor.

7. The coaxial support structure of claim 1 wherein said inner conductor is provided with interior threading in order to facilitate attachment of associated transmission elements.

8. The coaxial support structure of claim 1 wherein said dielectric spacer is formed so as to provide no opposing radial symmetry of solid material.

9. In a coaxial support structure including an outer conductor and a coaxial inner conductor, separated and supported in relative position to each other by a dielectric spacer member, the improvement comprising:

providing said dielectric spacer member to have odd radial symmetry to minimize sustaining higher order mode effects therein;

truncating said dielectric spacer at each end thereof such that the ends of said outer conductor and said inner conductor extend beyond the ends of said dielectric spacer; and said outer conductor is provided with tapered depressions to receive positioning beads situated on each of the radial vanes, the tapered depressions being tapered inward form the end surfaces of said outer conductor, such that material shrinkage in said dielectric spacer will result in a tightened mechanical fit and three dimensional captivation of said dielectric spacer by said outer conductor.

10. The improvement of claim 9 wherein said dielectric spacer is in the form of a plastic material injection molded through a single injection port into position within said outer conductor.

11. The improvement of claim 9 wherein said dielectric spacer includes a central tube portion surrounding and mechanically captivating said inner conductor and an odd plurality of equally spaced radial vane members extending to abut against an interior surface of said outer conductor.

12. The improvement of claim 9 wherein said dielectric spacer has three equally spaced vane members extending radially intermediate said inner conductor and said outer conductor.

13. A coaxial support structure adapted to mate with two external connecting elements, comprising:

an outer conductor in the form of an annular cylindrical member having opposing end surfaces, a peripheral surface and an interior surface;

an interior conductor similar in shape to and disposed coaxially within said outer conductor, said inner conductor including opposing end surfaces, a peripheral surface and an interior surface; and a dielectric spacer member disposed intermediate said outer conductor and said inner conductor and being secured thereto such that said inner conductor is captivated in axial, radial and rotational dimensions with respect to said outer conductor, said dielectric spacer including a central captivation section for captivating said inner conductor and an odd plurality of equally spaced radial vane members extending form the central captivation section to the interior surface of said outer conductor, said dielectric spacer being captivated within said outer conductor by interiorly tapering depressions formed in the interior surface of said outer conductor which receive positioning beads formed to extend inward form the spacer end surfaces at the positions where the radial vane members abut against the interior surface of said outer conductor.

14. The coaxial support structure of claim 13 wherein the peripheral surface of said inner conductor is provided with spiral grooving to mate with the material of said dielectric spacer so as to enhance the captivation of said inner conductor by said dielectric spacer.

15. The coaxial support structure of claim 13 wherein the interior surface of said inner conductor is provided with threading so as to accept and secure a correspondingly threaded center pin conductor situated on one of said external connecting elements.

16. The coaxial support structure of claim 13 wherein each end surface of each of said inner conductor and said outer conductor are formed such that at least an annular portion thereof is smooth and is arrayed to be coplanar, in an end plane, with the end surface of the other conductor situated on the same end; and the central captivation section and the radial vanes of said dielectric spacer have opposing coplanar space end surfaces at each end thereof, said spacer end surfaces being disposed in a transverse plane parallel to and inwardly displaced from the end plane so as to form an end gap therebetween.

17. The coaxial support structure of claim 16 wherein axially extending interstices are disposed intermediate said radial vane members;

an end gap is formed intermediate each spacer end surface and the corresponding end plane; and a dust washer is disposed within said end gap so as to prevent particulate contamination within the interstices.

* * * * *